US011185143B2

(12) United States Patent
Yoshii

(10) Patent No.: US 11,185,143 B2
(45) Date of Patent: Nov. 30, 2021

(54) NAIL PRINTING DEVICE

(71) Applicant: CASIO COMPUTER CO., LTD., Tokyo (JP)

(72) Inventor: Masakazu Yoshii, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 232 days.

(21) Appl. No.: 16/040,685

(22) Filed: Jul. 20, 2018

(65) Prior Publication Data

US 2019/0037997 A1 Feb. 7, 2019

(30) Foreign Application Priority Data

Aug. 4, 2017 (JP) ..... JP2017-151195

(51) Int. Cl.

| | |
|---|---|
| ***A45D 29/22*** | (2006.01) |
| ***A45D 29/00*** | (2006.01) |
| ***B41F 17/34*** | (2006.01) |
| ***B41J 3/407*** | (2006.01) |

(52) U.S. Cl.

CPC ..... *A45D 29/22* (2013.01); *A45D 29/00* (2013.01); *B41F 17/34* (2013.01); *B41J 3/407* (2013.01); *A45D 2029/005* (2013.01)

(58) Field of Classification Search

CPC .... A45D 29/00; A45D 29/22; A45D 2029/00; A45D 2029/005; A45D 34/00; A45D 34/04; A45D 24/20; B41F 17/34; A61G 13/124; A61G 13/12; B41J 3/40731; B41J 3/4073; B41M 1/40

USPC ..... 132/73; 128/845; 248/118, 118.1, 118.3; 607/111, 145, 150

See application file for complete search history.

(56) References Cited

U.S. PATENT DOCUMENTS

| | | | | |
|---|---|---|---|---|
| 6,035,860 | A * | 3/2000 | Mombourquette .... | A45D 29/00 132/200 |
| 6,286,517 | B1 | 9/2001 | Weber et al. | |
| 6,450,174 | B2 * | 9/2002 | Mulaisho ..... | A45D 29/18 132/73 |
| 8,681,359 | B2 * | 3/2014 | Bitoh ..... | A45D 29/00 132/73 |
| 8,721,068 | B2 | 5/2014 | Yamasaki | |
| 8,752,956 | B2 | 6/2014 | Bitoh | |

(Continued)

FOREIGN PATENT DOCUMENTS

| | | | |
|---|---|---|---|
| CN | 102886983 | A | 1/2013 |
| JP | 2012135600 | A | 7/2012 |

(Continued)

OTHER PUBLICATIONS

Chinese Office Action (and English language translation thereof) dated Jan. 2, 2020 issued in counterpart Chinese Application No. 201810868206.4.

(Continued)

*Primary Examiner* — Rachel R Steitz
*Assistant Examiner* — Karim Asqiriba
(74) *Attorney, Agent, or Firm* — Holtz, Holtz & Volek PC

(57) ABSTRACT

A nail printing device includes: a base; a finger placing portion provided on an upper surface side of the base; a grip portion provided on a lower surface side of the base and near a lower portion of the finger placing portion; and a print head configured to perform printing on a nail of a finger placed on the finger placing portion.

15 Claims, 10 Drawing Sheets

(56) References Cited

U.S. PATENT DOCUMENTS

| | | | | |
|---|---|---|---|---|
| 9,090,092 | B2 * | 7/2015 | Bitoh | A45D 29/00 |
| 2002/0014245 | A1 | 2/2002 | Mulaisho | |
| 2012/0147107 | A1 * | 6/2012 | Bitoh | A45D 29/00 347/101 |
| 2013/0021395 | A1 * | 1/2013 | Bitoh | A45D 29/00 347/2 |
| 2013/0235137 | A1 * | 9/2013 | Nakayama | A45D 29/00 347/102 |
| 2014/0267517 | A1 * | 9/2014 | Yamasaki | B41J 3/4073 347/101 |

FOREIGN PATENT DOCUMENTS

| | | | |
|---|---|---|---|
| JP | 2012152410 | A | 8/2012 |
| JP | 2013022113 | A | 2/2013 |
| JP | 2013022114 | A | 2/2013 |

OTHER PUBLICATIONS

Japanese Office Action (and English language translation thereof) dated May 25, 2021 issued in Japanese Application No. 2017-151195.

Chinese Office Action (and English language translation thereof) dated Oct. 20, 2020 issued in Chinese Application No. 201810868206.4.

* cited by examiner

NAIL PRINTING DEVICE

CROSS-REFERENCE TO RELATED APPLICATIONS

This application is based upon and claims the benefit of priority under 35 USC 119 of Japanese Patent Application No. 2017-151195 filed on Aug. 4, 2017 the entire disclosure of which, including the description, claims, drawings, and abstract, is incorporated herein by reference in its entirety.

BACKGROUND OF THE INVENTION

The present invention relates to a nail printing device.

DESCRIPTION OF THE RELATED ART

A nail printing device is a printing device that places a finger with a nail to be printed (printing finger) on a placing plate provided in a device main body and performs printing on the nail of the printing finger. However, in a case where the printing finger is placed on the placing plate, since a hand is unstable, movements of the hand and the arm are transmitted to the printing finger and may make the printing finger move. If the printing finger moves during printing and the position of the finger is changed, a pattern and the like cannot be correctly printed on the nail, and a printing error is caused.

Therefore, conventionally, a nail printing device has been known in which the printing finger is placed on a finger placing place fixed to the device and the printing finger is fixed with a finger placing plate member so as not to move the printing finger (for example, refer to U.S. Pat. No. 6,286,517 and JP 2012-152410 A).

When a hand is placed on a flat plate, nails of a little finger, a ring finger, a middle finger, and an index finger are substantially parallel to the flat plate. However, a nail of a thumb is normally inclined with respect to the flat plate. Therefore, when printing is performed on the nail of the thumb placed on the flat plate, it is necessary to fit print data to the inclination of the nail. Here, since an inclination angle of the nail varies for each individual, it is difficult to create the printing data.

BRIEF SUMMARY

According to an embodiment of the present invention, a nail printing device includes: a base; a finger placing portion provided on an upper surface side of the base; a grip portion provided on a lower surface side of the base and near a lower portion of the finger placing portion; and a print head configured to perform printing on a nail of a finger placed on the finger placing portion.

DETAILED DESCRIPTION OF THE INVENTION

Figure 1:
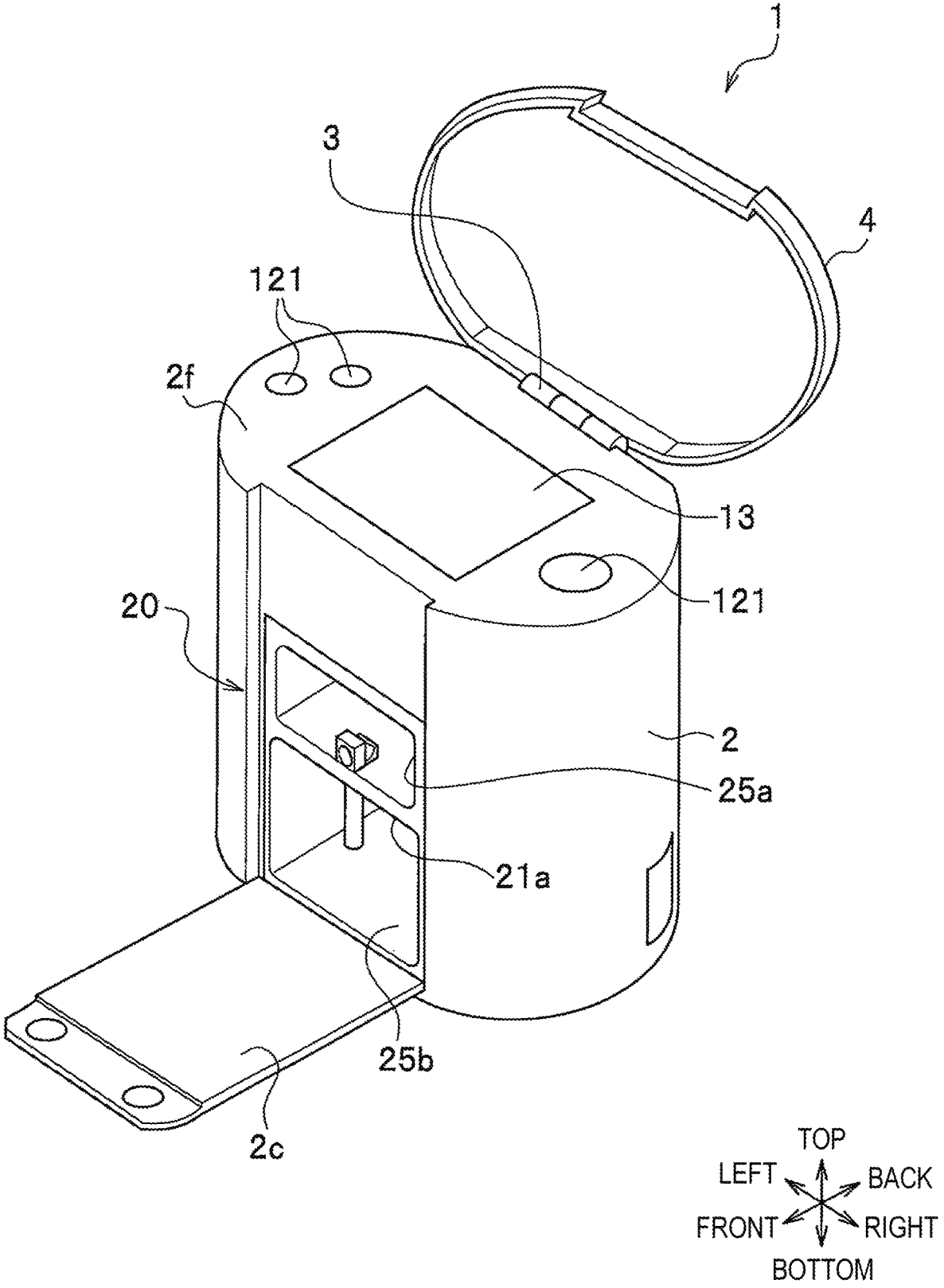
FIG. 1 is a perspective view illustrating an appearance of a nail printing device according to the present embodiment.

Hereinafter, an embodiment of the present invention (hereinafter referred to as "the present embodiment") will be described in detail with reference to the drawings. Note that the drawings are only schematically illustrated to an extent that the present embodiment can be sufficiently understood. In each of the drawings, common components and similar components are denoted with the same reference numerals, and overlapped description will be omitted.

Embodiment

FIG. 1 is a perspective view illustrating an appearance of a nail printing device according to the present embodiment.

As illustrated in FIG. 1, a nail printing device 1 includes a case body 2 and a lid 4. The case body 2 and the lid 4 are coupled to each other via a hinge 3 provided at a rear end portion of an upper surface of the case body 2.

The case body 2 is formed in an oval shape in plan view. An opening/closing plate 2*c* is provided on a frontside of the case body 2 in a tiltable state. The opening/closing plate 2*c* is coupled to the case body 2 via a hinge (not shown) provided at a lower end portion of the front surface of the case body 2. The opening/closing plate 2*c* is provided to open and close the front surface of the case body 2, and a finger placing plate 20 including a flat plate shaped base 21*a* is exposed in a state where the front surface of the case body 2 is opened. In the finger placing plate 20, a printing finger inserting portion 25*a* (FIG. 1) is formed above the base 21*a*, and a non-printing finger inserting portion 25*b* is formed below the base 21*a*. A plurality of operation buttons 121 is provided on a top board 2*f* of the case body 2, and a display unit 13 is disposed substantially at the center of the top board 2*f*. Shape and configurations of the case body 2 and the lid 4 are not limited to those exemplified here.

Figure 2:
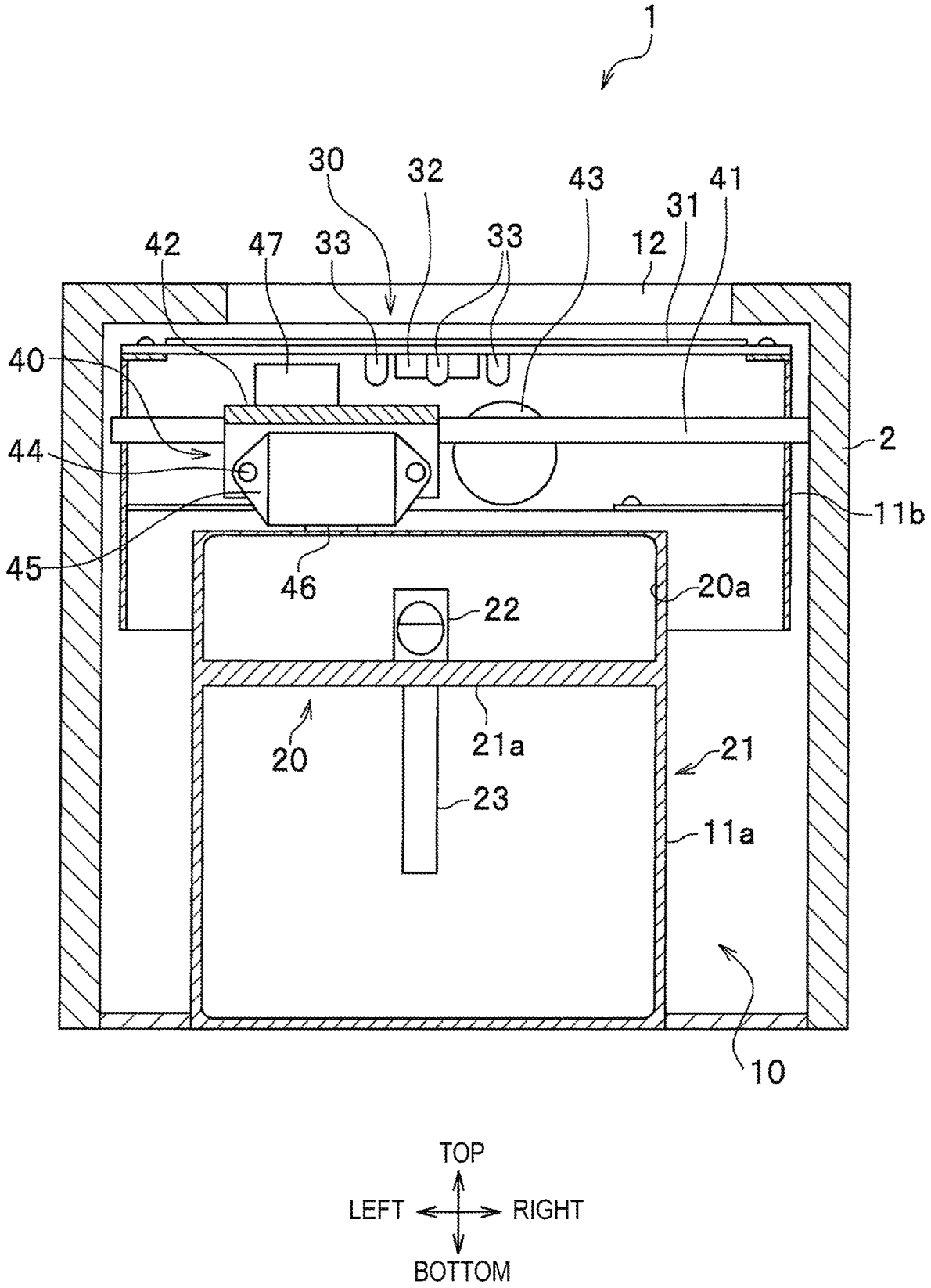
FIG. 2 is a cross-sectional view of a front side of the nail printing device according to the present embodiment.
Figure 3:
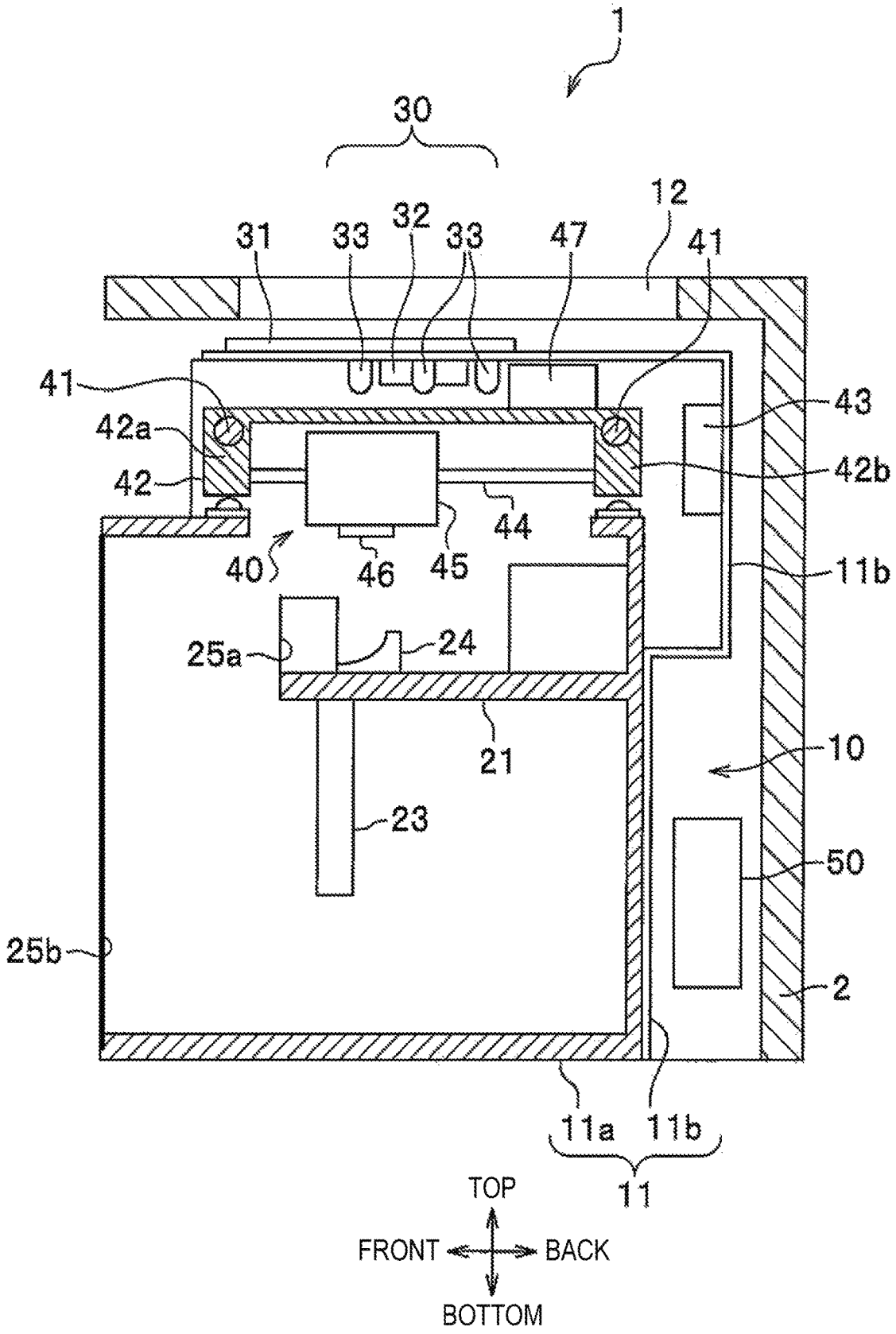
FIG. 3 is a side sectional view of the nail printing device.

FIG. 2 is a cross-sectional view of a front side of the nail printing device according to the present embodiment, and FIG. 3 is a side sectional view of the nail printing device.

As illustrated in FIGS. 2 and 3, a device main body 10 of the nail printing device 1 is housed in the case body 2. The device main body 10 includes the finger placing plate 20 (20*a*), an imaging unit 30, a printing unit 40, and a controlling unit 50. The finger placing plate 20, the imaging unit 30, the printing unit 40, and the controlling unit 50 are provided in a machine frame 11 including a lower machine frame 11*a* and an upper machine frame 11*b*. The lower machine frame 11*a* is formed in a box shape provided in the lower portion of the case body 2. The upper machine frame 11*b* is provided above the lower machine frame 11*a* and in the upper portion of the case body 2.

The finger placing plate 20 (20*a*) is provided in the lower machine frame 11*a* in the machine frame 11. The finger placing plate 20 includes a frame body 21 formed on the lower machine frame 11*a*, a finger placing portion 22, a grip portion 23, and a placing plate 24. Furthermore, the frame body 21 includes the flat plate shaped base 21*a*, and the printing finger inserting portion 25*a* (FIG. 1) and the non-printing finger inserting portion 25*b* are formed above and below the frame body 21.

Figure 4A:
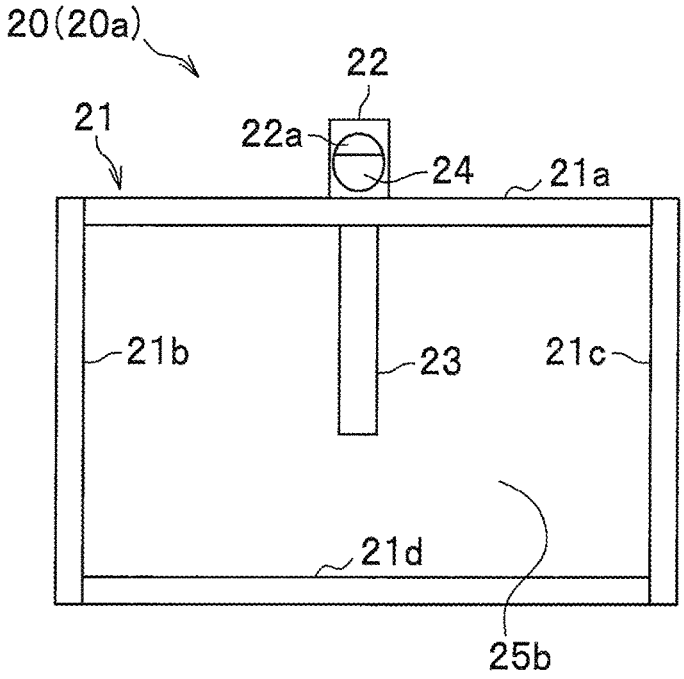
FIGS. 4A to 4C are schematic configuration diagrams of a finger placing portion according to the present embodiment.
Figure 4B:
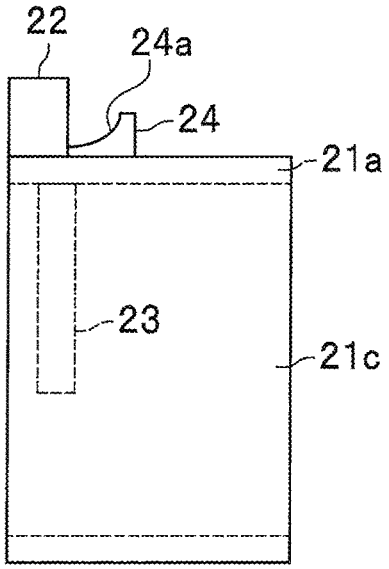
Figure 4C:
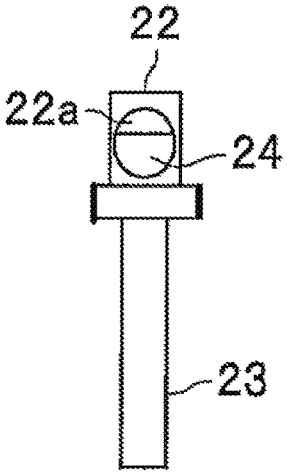

FIGS. 4A to 4C are schematic configuration diagrams of the finger placing plate according to the present embodiment. FIG. 4A is a front view of the finger placing plate, and FIG. 4B is a side view of the finger placing plate.

The finger placing plate 20*a* includes the frame body 21, the finger placing portion 22, the grip portion 23, and the placing plate 24, and the frame body 21 includes the flat plate shaped base 21*a*, a left side plate 21*b*, a right side plate 21*c*, and a lower plate 21*d*. The finger placing portion 22 is provided on the upper side of the base 21*a* and is an annular member having a hole 22*a* through which a finger passes.

The grip portion 23 is a member gripped by the little finger, the ring finger, the middle finger, and the index finger when the thumb is inserted into the hole 22*a* of the finger placing portion 22. The grip portion 23 is fixed to the lower surface of the base 21*a* and is projected downward from the base 21*a*. Since the grip portion 23 has a cylindrical shape of which one end surface is fixed to the base 21*a*, the grip portion 23 is formed symmetrically with respect to a plane where the direction of the hole 22*a* intersects with a vertical line of the base 21*a*. Therefore, the grip portion 23 can be grasped by a right hand or a left hand without uncomfortable feeling.

The grip portion 23 may be formed integrally with the finger placing plate 20*a* and may be removable from the base 21*a*, together with the finger placing plate 20*a* as illustrated in FIG. 4C.

The placing plate 24 is a table where a ball of a finger is placed, and an upper surface 24*a* has a shape of the ball of the finger (concave shape). The placing plate 24 is provided at the rear portion of the finger placing plate 20 and above the base 21*a*. Note that the placing plate 24 may function as a pressing member for pressing fingers upward by using an elastic member. As a result, since the finger is brought into contact with the upper side of the hole 22*a* of the finger placing portion 22, positions (height) of nails are uniformed.

Figure 5:
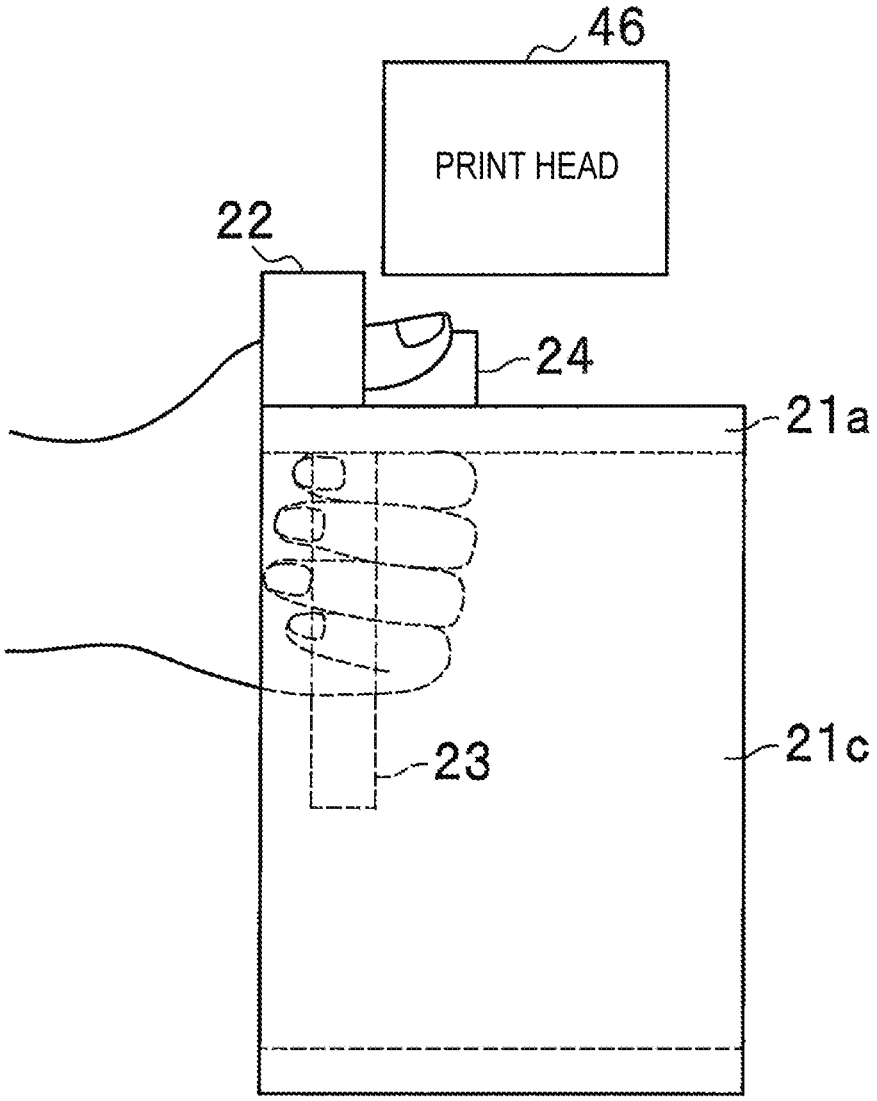
FIG. 5 is a side view illustrating a state where a thumb is inserted into a hole of the finger placing portion according to the present embodiment.
Figure 6A:
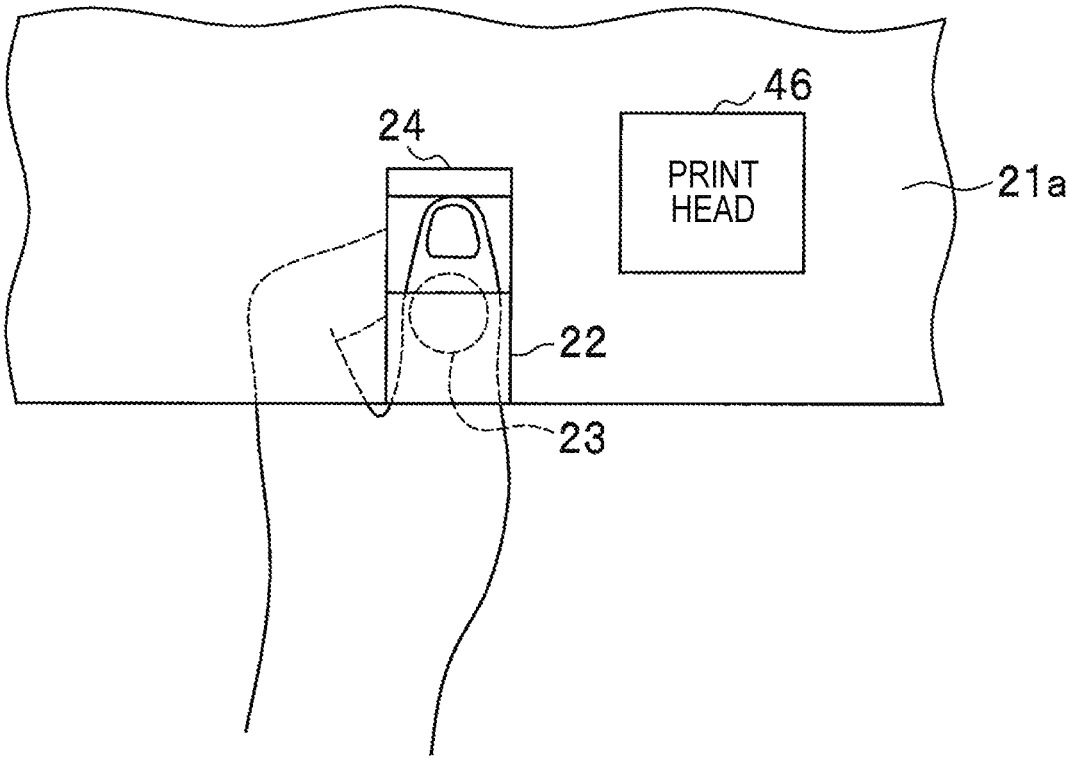
FIGS. 6A and 6B are a plan view and a rear view illustrating a state where a thumb is inserted into the hole of the finger placing portion according to the present embodiment.
Figure 6B:
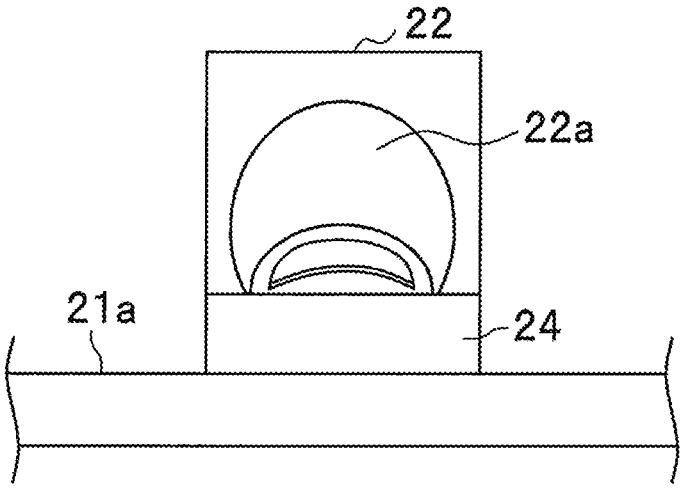

FIG. 5 is a side view illustrating a state where a thumb is inserted into the hole of the finger placing portion according to the present embodiment, and FIGS. 6A and 6B are a plan view and a rear view illustrating a state where a thumb is inserted into the hole of the finger placing portion according to the present embodiment.

A user of the nail printing device 1 inserts a thumb into the hole 22*a* of the finger placing portion 22. With this movement, a ball of the thumb is placed (held) on the upper side of the placing plate 24. As a result, since a ball of the thumb is placed along a concave shape of the upper surface 24*a* of the placing plate 24 (FIG. 4B), the user does not feel discomfort. In addition, the user strongly grasps the grip portion 23 with a little finger, a ring finger, a middle finger, and an index finger. With this grasp, the position of the thumb is stabilized, and the nail is positioned parallel to the base 21*a* (FIG. 6B). Accordingly, a print head 46 can accurately eject ink at a target position. FIGS. 5 and 6A and 6B illustrate a state where the grip portion 23 is grasped with the left hand. Furthermore, although the upper end surface of the grip portion 23 has been fixed to the base 21*a*, a lower end surface may also be fixed to the lower plate 21*d*.

Figure 7:
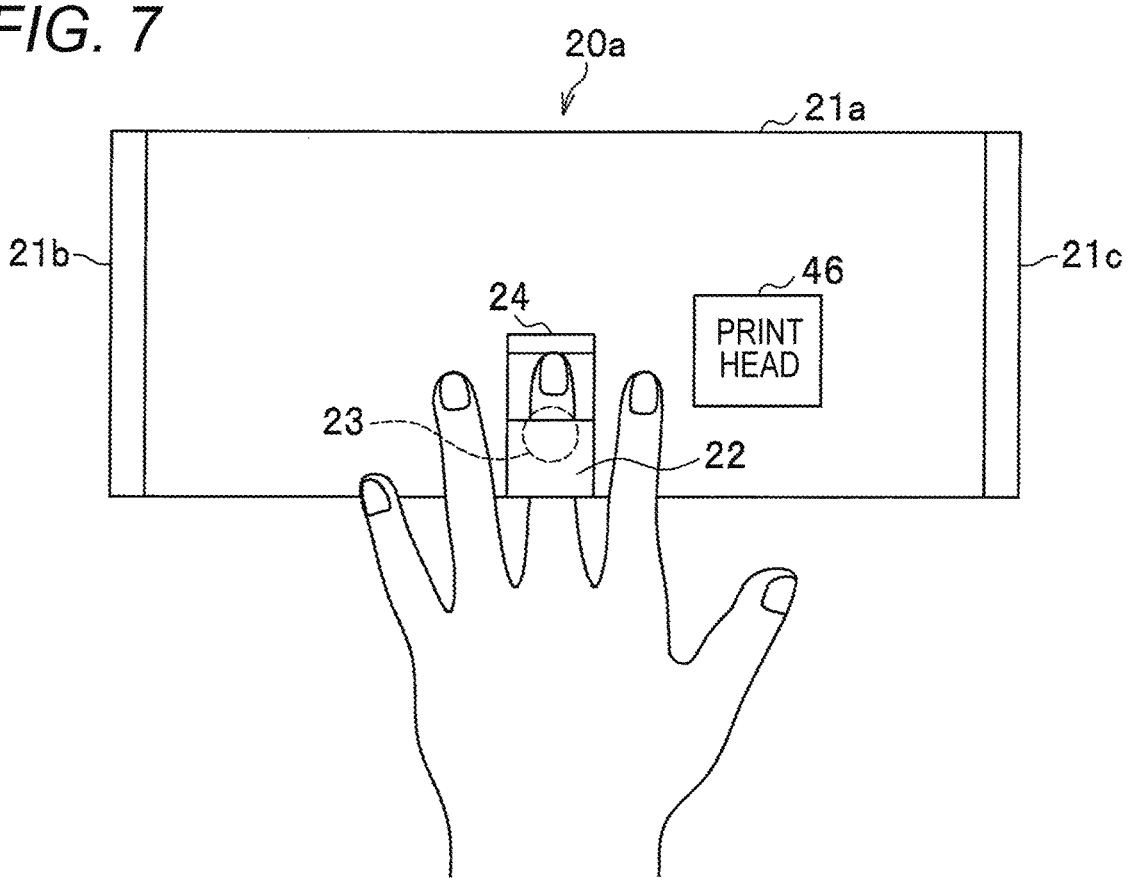
FIG. 7 is a plan view illustrating a state where an index finger is inserted into the hole of the finger placing portion according to the present embodiment.

FIG. 7 is a plan view illustrating a state where the index finger is inserted into the hole of the finger placing portion according to the present embodiment.

The user of the nail printing device 1 inserts any one of the little finger, the ring finger, the middle finger, and the index finger into the hole 22*a* of the finger placing portion 22 and places the other fingers on the top of the base 21*a*. For example, in FIG. 7, the user inserts the middle finger into the hole 22*a* and places the little finger, the ring finger, and the index finger on the top of the base 21*a*. Here, a ball of the middle finger is placed (held) on the upper surface 24*a* of the placing plate 24 (FIG. 4B).

Here, return to the description on the cross-sectional views in FIGS. 2 and 3.

The imaging unit 30 is provided in the upper machine frame 11*b* and includes a substrate 31, a camera 32, and a plurality of illumination lamps 33. The illumination lamps 33 are white LEDs disposed around the camera 32. The imaging unit 30 is an imaging unit that illuminates a finger placed on the base 21*a* and a finger inserted into the hole 22*a* of the finger placing portion 22 with the illumination lamps 33 and images a nail with the camera 32.

The printing unit 40 is provided in the upper machine frame 11*b* and is an image forming unit that forms an image such as a color or a pattern on the nail of the finger to be printed. The printing unit 40 includes guide rods 41, a main carriage 42, motors 43 and 47, guide rods 44, a sub carriage 45, the print head 46, and the like.

The two guide rods 41 are provided in parallel to both side plates of the upper machine frame 11*b*. The main carriage 42 is slidably provided with respect to the guide rods 41. The two guide rods 44 are provided in parallel to a front wall 42*a* and a rear wall 42*b* of the main carriage 42. The sub carriage 45 is slidably provided with respect to the guide rods 44. The print head 46 is mounted at the center of the lower surface of the sub carriage 45.

Furthermore, the main carriage 42 is coupled to the motor 43 via a power transmission unit (not shown) and moves along the guide rods 41 in the horizontal direction. Furthermore, the sub carriage 45 is coupled to the motor 47 via a power transmission unit (not shown) and moves along the guide rods 44 in the horizontal direction. With this structure, the print head 46 can freely move in the front-back direction and the horizontal direction.

A printing method of the print head 46 is an inkjet method in which printing is performed by ejecting dropletized ink to medium to be printed (nail). The printing method of the print head 46 is not limited to the ink jet method.

Comparative Example 1

Figure 8:
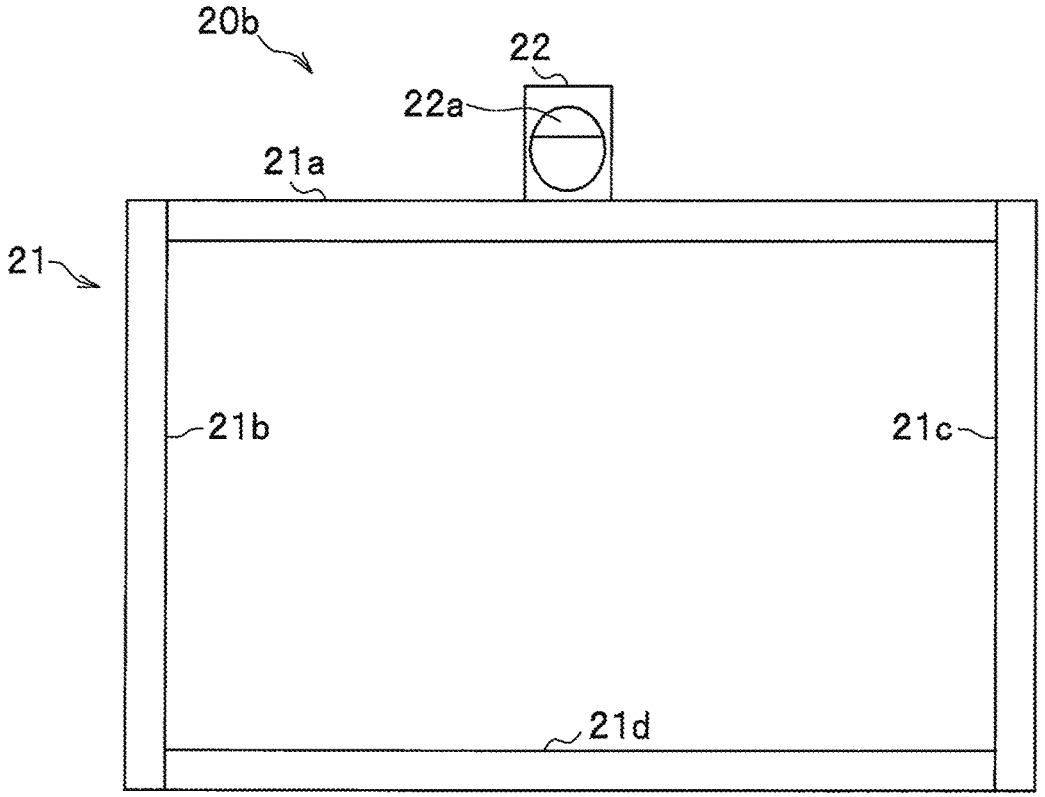
FIG. 8 is a schematic configuration diagram of a finger placing portion according to a comparative example.

FIG. 8 is a schematic configuration diagram of a finger placing portion according to a comparative example.

A finger placing plate 20*b* includes a frame body 21, a finger placing portion 22, and a placing plate 24, and the frame body 21 includes a flat plate shaped base 21*a*, a left side plate 21*b*, a right side plate 21*c*, and a lower plate 21*d*. That is, the finger placing plate 20*b* according to the comparative example is different from the finger placing plate 20*a* according to the embodiment in that the grip portion 23 is not included.

Figure 9A:
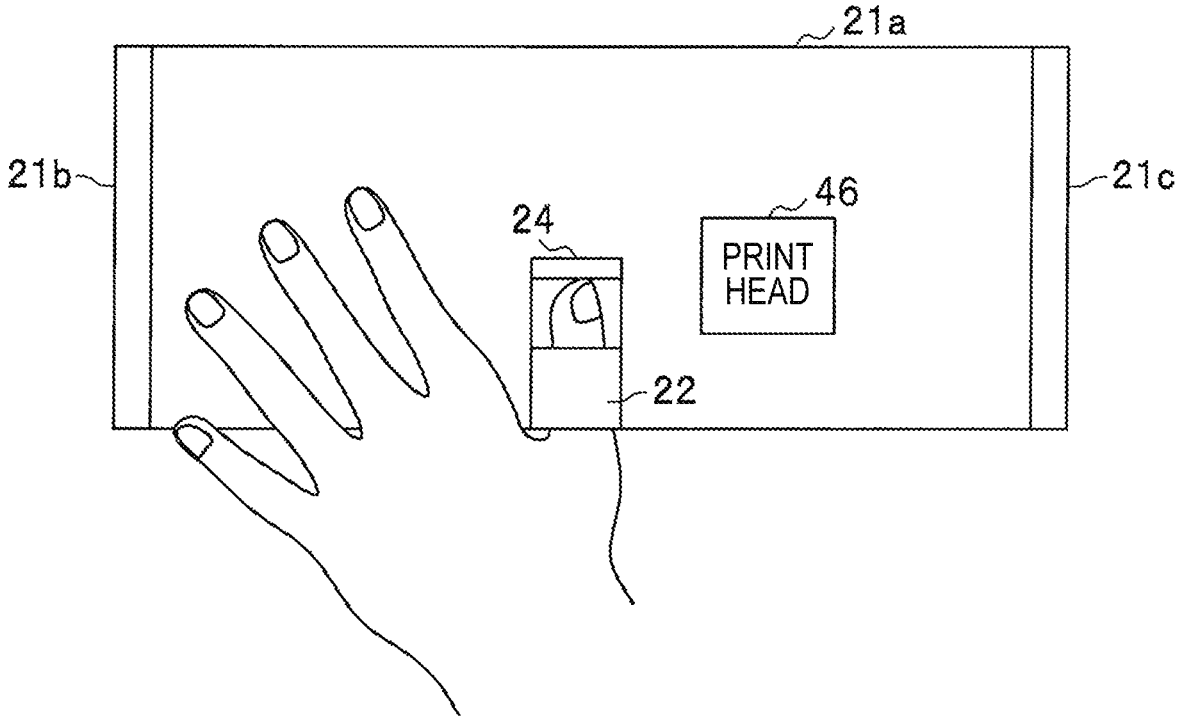
FIGS. 9A and 9B are diagrams illustrating a state where a thumb is inserted into a hole of the finger placing portion according to the comparative example.
Figure 9B:
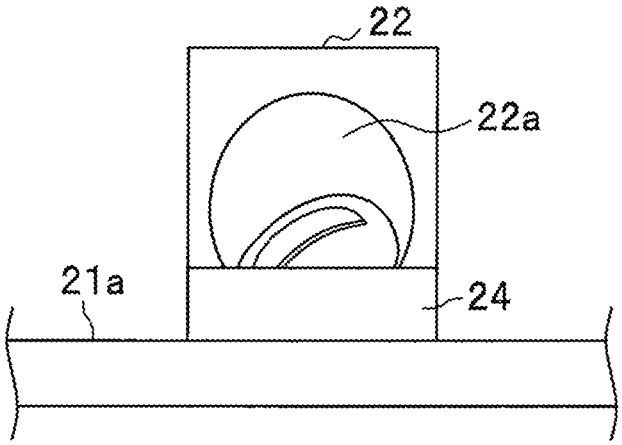

FIGS. 9A and 9B are diagrams illustrating a state where a thumb is inserted into a hole of the finger placing portion according to the comparative example. FIG. 9A is a plan view, and FIG. 9B is a rear view.

A user of a nail printing device 1 inserts a thumb into a hole 22*a* of a finger placing portion 22 and places a little finger, a ring finger, a middle finger, and an index finger on a top of the base 21*a* (refer to FIG. 9A). At this time, the thumb is inclined with respect to the base 21*a* (refer to FIG. 9B), and a ball of the thumb does not fit to a concave shape of an upper surface 24*a* of a placing plate 24 (FIG. 4B). As a result, the user feels discomfort at the ball of the thumb.

On the other hand, the finger placing plate 20*a* according to the embodiment includes a cylindrical grip portion 23 and has a structure in which the user grasps the grip portion 23 with the little finger, the ring finger, the middle finger, and the index finger. Therefore, a nail of the thumb is substantially parallel to the base 21*a* (refer to FIG. 6B). As a result, the ball of the thumb fits the shape of the concave shape of the placing plate 24, and the user does not feel uncomfortable.

Comparative Example 2

Figure 10:
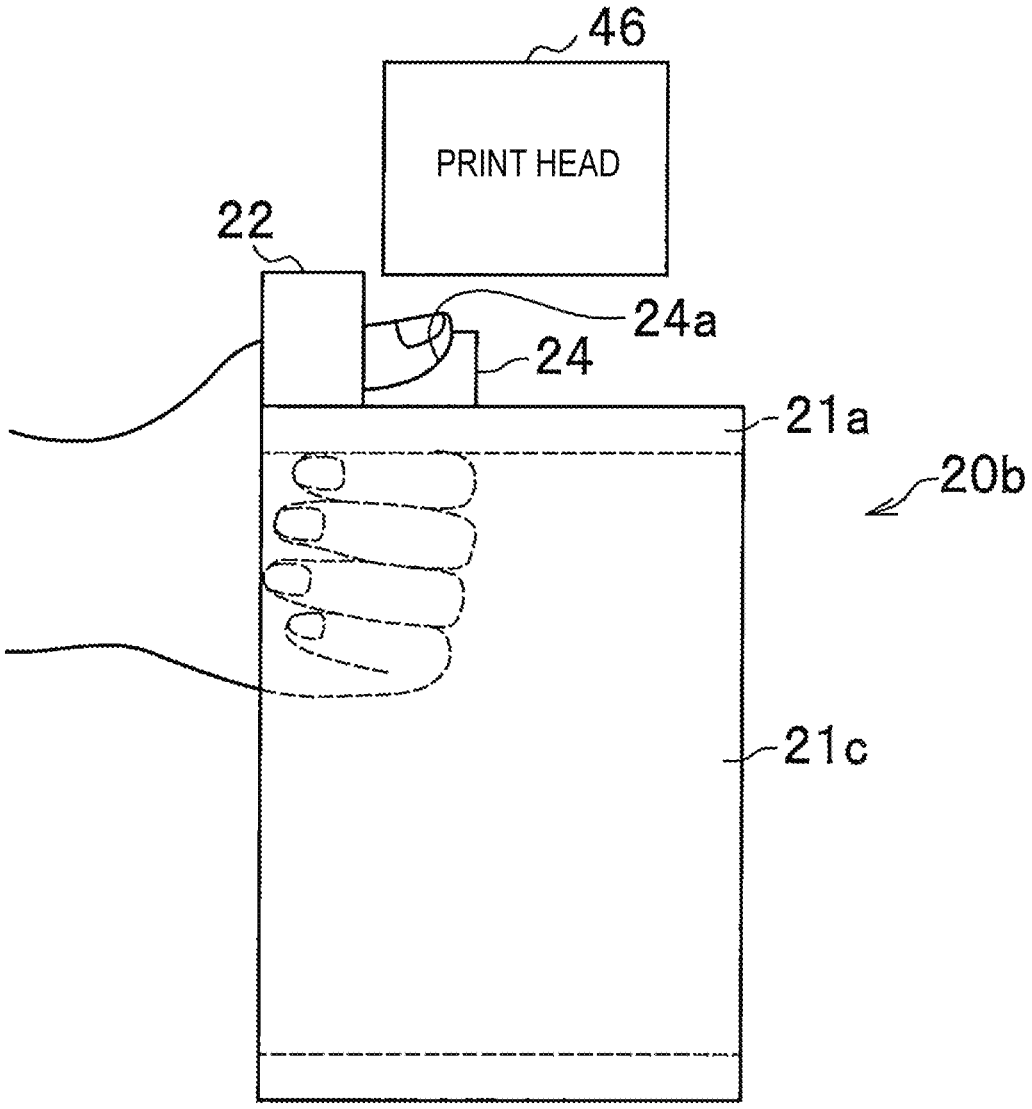
FIG. 10 is a diagram of a state where a thumb is inserted into a hole of a finger placing portion and a hand is clasped so that a little finger, a ring finger, a middle finger, an index finger are in close contact with a palm.

FIG. 10 is a diagram of a state where a thumb is inserted into a hole of a finger placing portion and a hand is clasped so that a little finger, a ring finger, a middle finger, an index finger are in close contact with a palm.

That is, FIG. 10 illustrates a state where the thumb is inserted into a hole 22*a* of a finger placing portion 22 using a finger placing plate 20*b* (FIG. 8) and a hand is clasped so that a little finger, a ring finger, a middle finger, an index finger are in close contact with a palm without placing the little finger, the ring finger, the middle finger, and the index finger on a base 21*a*. As in the embodiment, a ball of the middle finger is placed (held) on an upper surface 24*a* of the placing plate 24. As a result, the ball of the thumb fits a concave shape of the placing plate 24, and a user does not feel uncomfortable. However, since the little finger, the ring finger, the middle finger, and the index finger are not fixed, the position of the thumb is unstable. On the other hand, the finger placing plate 20*a* according to the embodiment includes a cylindrical grip portion 23 and has a structure in which the user grasps the grip portion 23 with the little finger, the ring finger, the middle finger, and the index finger. Therefore, the position of the thumb is fixed.

Modification

The present invention is not limited to the embodiment, and for example, various modifications as described below are possible.

(1) The grip portion 23 according to the embodiment has a cylindrical shape, and one end surface is fixed to the base 21*a*. However, the grip portion 23 may have a semi-cylindrical shape.

Figure 11A:
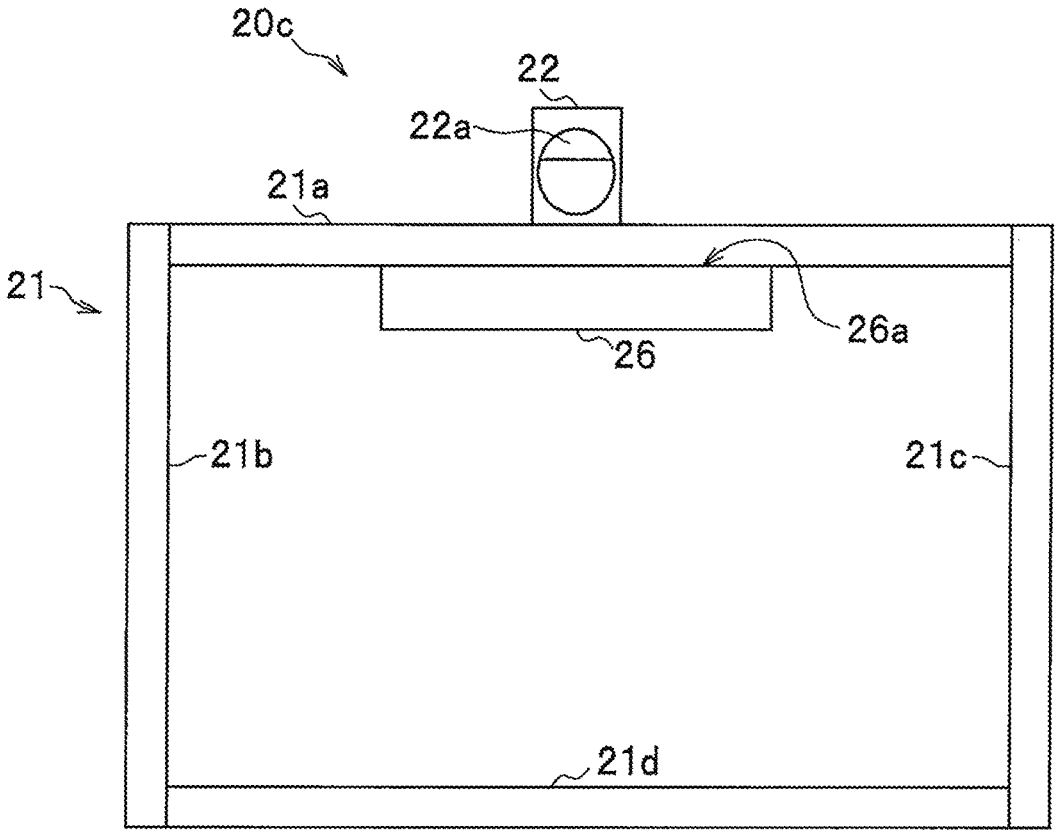
FIGS. 11A and 11B are schematic configuration diagrams of a finger placing portion according to a modification.
Figure 11B:
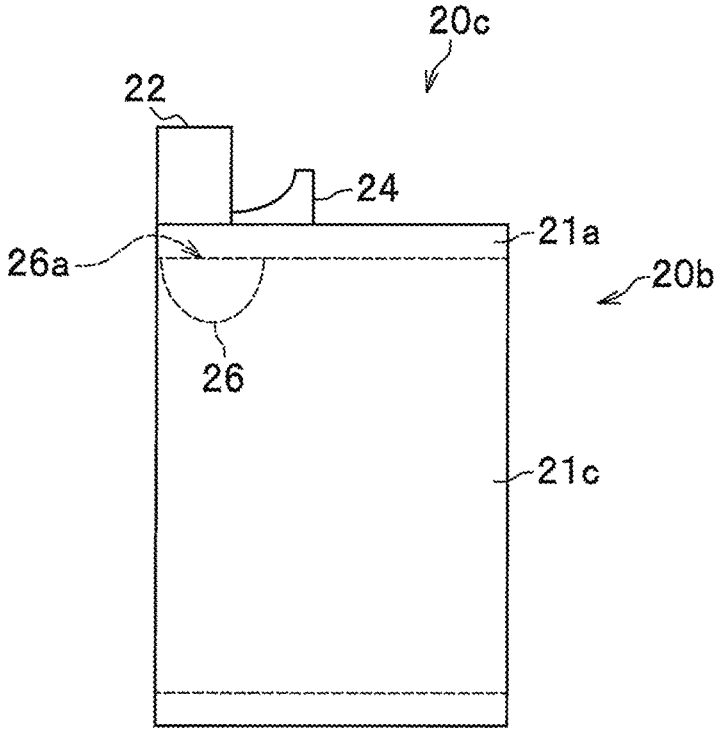

FIGS. 11A and 11B are schematic configuration diagrams of a finger placing portion according to the modification. FIG. 11A is a front view, and FIG. 11B is a right side view.

A finger placing plate 20*c* includes a frame body 21, a finger placing portion 22, and a placing plate 24, and a grip portion 26, and the frame body 21 includes a flat plate shaped base 21*a*, a left side plate 21*b*, a right side plate 21*c*, and a lower plate 21*d*. That is, the finger placing plate 20*c* according to the modification is different from the finger placing plate 20*a* according to the embodiment in that the grip portion 23 is replaced with the grip portion 26.

The grip portion 26 has a semi-cylindrical shape, and a rectangular cut surface 26*a* of the cylindrical body is fixed to the lower surface of the base 21*a* and is projected downward from the base 21*a*. One of long sides of the cut surface 26*a* of the grip portion 26 substantially coincides with the front end portion of the base 21*a*.

With this structure, the user can insert the thumb into the hole 22*a* of the finger placing portion 22 and can grasp the grip portion 26 with the little finger, the ring finger, the middle finger, and the index finger. In addition, since the grip portion 26 is symmetrically arranged, it is possible to grab the grip portion 26 with the right hand or the left hand.

What is claimed is:

1. A nail printing device comprising:

a base having a substantially flat planar shape and including an upper side surface and a lower side surface opposing the upper side surface;

a finger placing portion provided on the upper side surface of the base;

a grip portion provided on the lower side surface of the base, the grip portion at least partially overlapping with a lower portion of the finger placing portion along a direction perpendicular to the base; and a print head configured to perform printing on a nail of a finger received in the finger placing portion, wherein the finger placing portion has a through-hole formed therethrough, the through-hole being configured to receive the finger so that the finger passes through the through-hole, wherein a central axis of the through-hole extends in a direction parallel to the base, and wherein the grip portion and the finger placing portion are provided at respective positions in relation to each other such that, when a nail of a thumb inserted through the through-hole of the finger placing portion is exposed such that printing can be performed thereon, the grip portion is grippable by at least one finger of the hand other than the thumb.

2. The nail printing device according to claim 1, wherein the grip portion is symmetrical about a plane which is perpendicular to the base and which extends along the central axis of the through-hole.

3. The nail printing device according to claim 1, wherein the grip portion is fixed to the lower side surface of the base and projects downward from the base.

4. The nail printing device according to claim 1, wherein the grip portion is integrally formed with the finger placing portion.

5. The nail printing device according to claim 1, wherein the grip portion is removably provided to the base.

6. The nail printing device according to claim 1, wherein an upper end surface of the grip portion is fixed to a lower surface of the base.

7. The nail printing device according to claim 1, further comprising:

a placing plate on which a ball of the finger is placed.

8. The nail printing device according to claim 7, wherein the placing plate is configured to press the finger placed on the placing plate against an inner surface of the finger placing portion.

9. The nail printing device according to claim 1, wherein in a case where a finger other than a first finger is inserted into the finger placing portion, fingers other than the inserted finger can be placed on the base.

10. The nail printing device according to claim 1, wherein the finger placing portion overlaps the grip portion along a height direction of the nail printing device.

11. A nail printing device comprising:

a base having a substantially flat planar shape and including an upper side surface and a lower side surface opposing the upper side surface;

a finger placing portion provided above the upper side surface of the base;

a grip portion provided below the lower side surface of the base, the grip portion at least partially overlapping with a lower portion of the finger placing portion along a direction perpendicular to the base, and an upper end surface of the grip portion being fixed to the lower side surface of the base;

a print head configured to perform printing on a nail of a finger received in the finger placing portion; and a placing plate on which a ball of the finger is placed, wherein the placing plate is configured to press the finger received in the placing plate against an inner surface of the finger placing portion.

12. The nail printing device according to claim 1, wherein the fingers of the hand other than the thumb include a little finger, a ring finger, a middle finger, and an index finger.

13. The nail printing device according to claim 8, wherein the placing plate comprises a concave surface on which the ball of the finger is placed, the concave surface curving upward towards the print head.

14. The nail printing device according to claim 11, wherein the finger placing portion and the placing plate are provided on the upper side surface of the base.

15. The nail printing device according to claim 14, wherein the placing plate comprises a concave surface on which the ball of the finger is placed, the concave surface curving upward towards the print head.

* * * * *